US008708023B2

(12) United States Patent
Wu

(10) Patent No.: US 8,708,023 B2
(45) Date of Patent: Apr. 29, 2014

(54) CORDLESS BLIND ASSEMBLY

(71) Applicant: Wen-Yu Wu, Kaohsiung (TW)

(72) Inventor: Wen-Yu Wu, Kaohsiung (TW)

( * ) Notice: Subject to any disclaimer, the term of this patent is extended or adjusted under 35 U.S.C. 154(b) by 0 days.

(21) Appl. No.: 13/627,564

(22) Filed: Sep. 26, 2012

(65) Prior Publication Data

US 2014/0083630 A1 Mar. 27, 2014

(51) Int. Cl.
*E06B 9/30* (2006.01)

(52) U.S. Cl.
USPC ..... 160/170; 160/172 R

(58) Field of Classification Search
USPC ..... 160/170, 171, 172 R, 107, 178.1 R, 160/84.04, 84.05, 291, 300, 301
See application file for complete search history.

(56) References Cited

U.S. PATENT DOCUMENTS 1,805,238 A * 5/1931 Duncanson ..... 160/172 R
2,130,403 A * 9/1938 Waltzinger ..... 160/172 R
2,174,249 A * 9/1939 Pratt ..... 160/172 R
2,549,691 A * 4/1951 Klonowski et al. ..... 160/172 R
2,625,220 A * 1/1953 Ferreira ..... 160/172 R
4,187,897 A * 2/1980 Frentzel ..... 160/177 R
4,341,254 A * 7/1982 Schaller et al. ..... 160/172 R
4,444,243 A * 4/1984 Voney et al. ..... 160/172 R
4,807,683 A * 2/1989 Hennequin et al. ..... 160/172 R
5,501,261 A * 3/1996 Peale ..... 160/168.1 R
6,029,734 A * 2/2000 Wang et al. ..... 160/170
6,330,899 B1 * 12/2001 Ciuca et al. ..... 160/170
2008/0128097 A1 * 6/2008 Yu et al. ..... 160/170

* cited by examiner

*Primary Examiner* — David Purol
(74) *Attorney, Agent, or Firm* — Muncy, Geissler, Olds & Lowe, P.C.

(57) ABSTRACT

Disclosed is a cordless blind assembly, comprising an upper frame rod with two blind cord winders disposed at two opposing sides, a retracting rod disposed beneath the upper frame rod, and two side guiding rails. A plurality of guiding components are disposed at the ends of the retracting rod. The driving cords from the blind cord winders connect to corresponding guiding components by going around both sides of the blind shading parts. The extended driving cords are hidden inside the side guiding rails where the guiding components can freely move inside the corresponding side guiding rails. Accordingly, the cordless blind assembly can avoid neck-strangling accidents to achieve easy DIY installation without breaking the function of the blind shading parts.

11 Claims, 7 Drawing Sheets

CORDLESS BLIND ASSEMBLY

FIELD OF THE INVENTION

The present invention relates to a control unit for an open/close device built-in or movably installed at window openings of a building and more specifically to a cordless blind assembly.

BACKGROUND OF THE INVENTION

Blinds of early days were controlled by blind cords where a switching controller was installed at one end of the track located on top of a blind. A bead chain or a blind cord was hanging down from the switching controller to open/close the blind by pulling the bead chain. However, accidents of strangling small children by the bead chains have been occurred, therefore, blinds with bead chains have been forbidden in many countries. Hence, cordless blinds become household necessities. Even though there are many different designs of cordless blinds, their switching operation is not as convenient as blinds with cords.

The conventional cordless blinds hide the blind cords inside the blind with an exposed spool to collect the blind cords where the extended blind cords will go through the blind shading parts such as blind shading leaves to connect to the retracting rod beneath. However, holes will be drilled on the blind shading parts for the blind cords to go through which are not easy for users to DIY. Moreover, the retracting rod retracts the blind cords by gravity which is vulnerable for poor retracting of the blind cord due to tilting or damage by striking. Furthermore, especially for cordless blind, the shading leaves are fixed by tying strings where the tying strings will interfere with the retraction of blind cords due to unexpected winding of tying strings.

SUMMARY OF THE INVENTION

The main purpose of the present invention is to provide a cordless blind assembly to prevent neck-strangling accidents with easy DIY installation without breaking the function of the blind shading parts.

Another purpose of the present invention is to provide a cordless blind assembly to avoid tilting or sticking of the retracting rod which is used to open/close the blind shading parts.

According to the present invention, a cordless blind assembly is disclosed and primarily comprises an upper frame rod, a retracting rod, a first side guiding rail and a second side guiding rail. A first cord winder and a second cord winder are installed at two opposing sides of the upper frame rod to release/retract a first driving cord and a second driving cord respectively. The retracting rod is disposed beneath the upper frame rod where a plurality of retractable blind shading parts are disposed between the upper frame rod and the retracting rod. A first guiding component is disposed at the first end of the retracting rod and a second guiding component is disposed at the second end of the retracting rod. The first driving cord goes around one side of the blind shading parts to connect to the first guiding component and the second driving cord goes around the other side of the blind shading parts to connect to the second guiding component. The top of the first side guiding rail is disposed at one side of the upper frame rod to hide the extended first driving cord where the first guiding component can freely move inside the first side guiding rail. The top of the second guiding rail is disposed at the other side of the upper frame rod to hide the extended second retracing cord where the second guiding component can freely move inside the second side guiding rail.

DETAILED DESCRIPTION OF THE INVENTION

With reference to the attached drawings, the present invention is described by means of the embodiment(s) below where the attached drawings are simplified for illustration purposes only to illustrate the structures or methods of the present invention by describing the relationships between the components and assembly in the present invention. Therefore, the components shown in the figures are not expressed with the actual numbers, actual shapes, actual dimensions, nor with the actual ratio. Some of the dimensions or dimension ratios have been enlarged or simplified to provide a better illustration. The actual numbers, actual shapes, or actual dimension ratios can be selectively designed and disposed and the detail component layouts may be more complicated.

Figure 1:
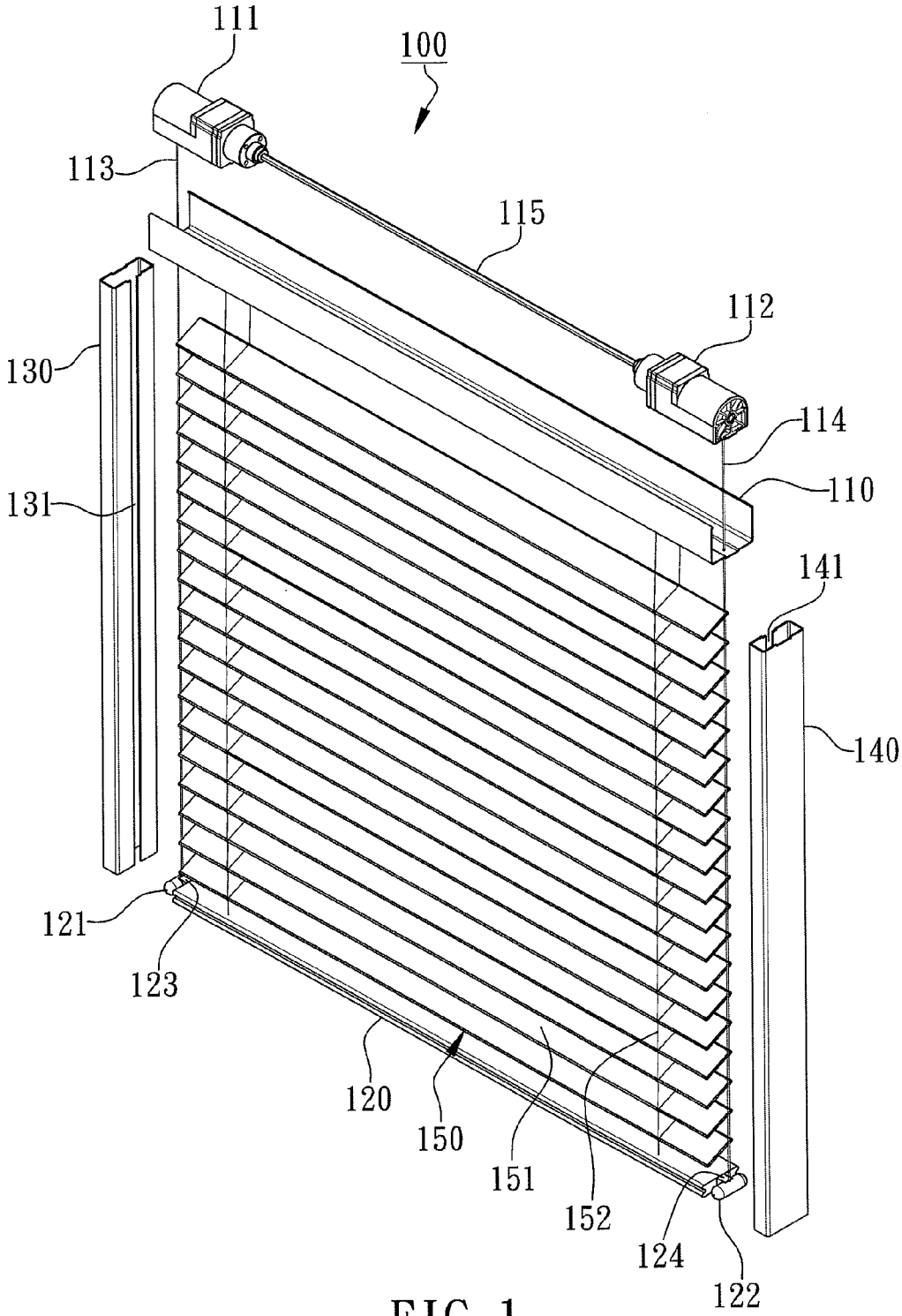
FIG. 1 is a three-dimensional component exploded view of a cordless blind assembly according to the first embodiment of the present invention.
Figure 2:
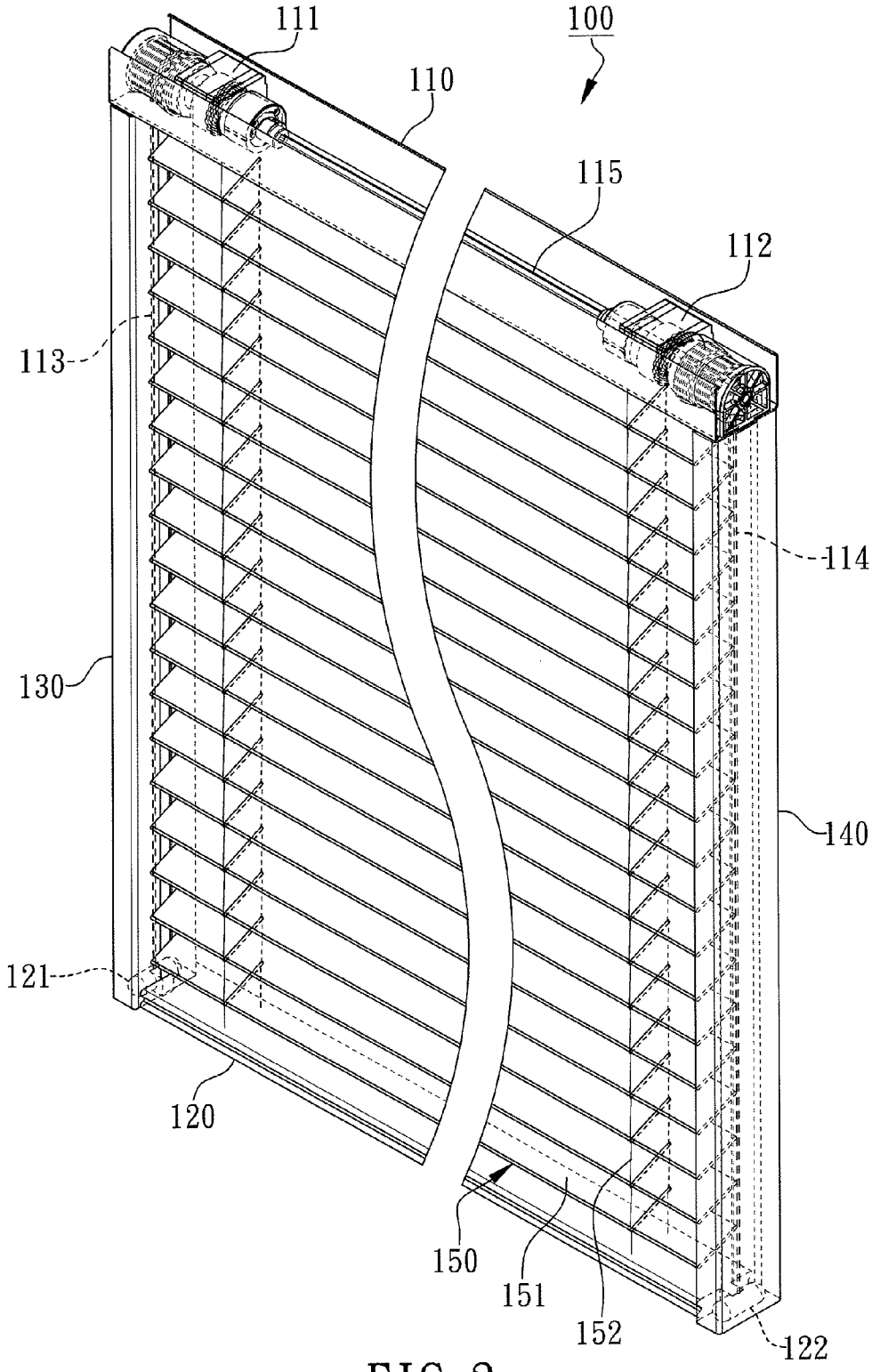
FIG. 2 is a three-dimensional assembly view of the cordless blind assembly according to the first embodiment of the present invention.
Figure 3:
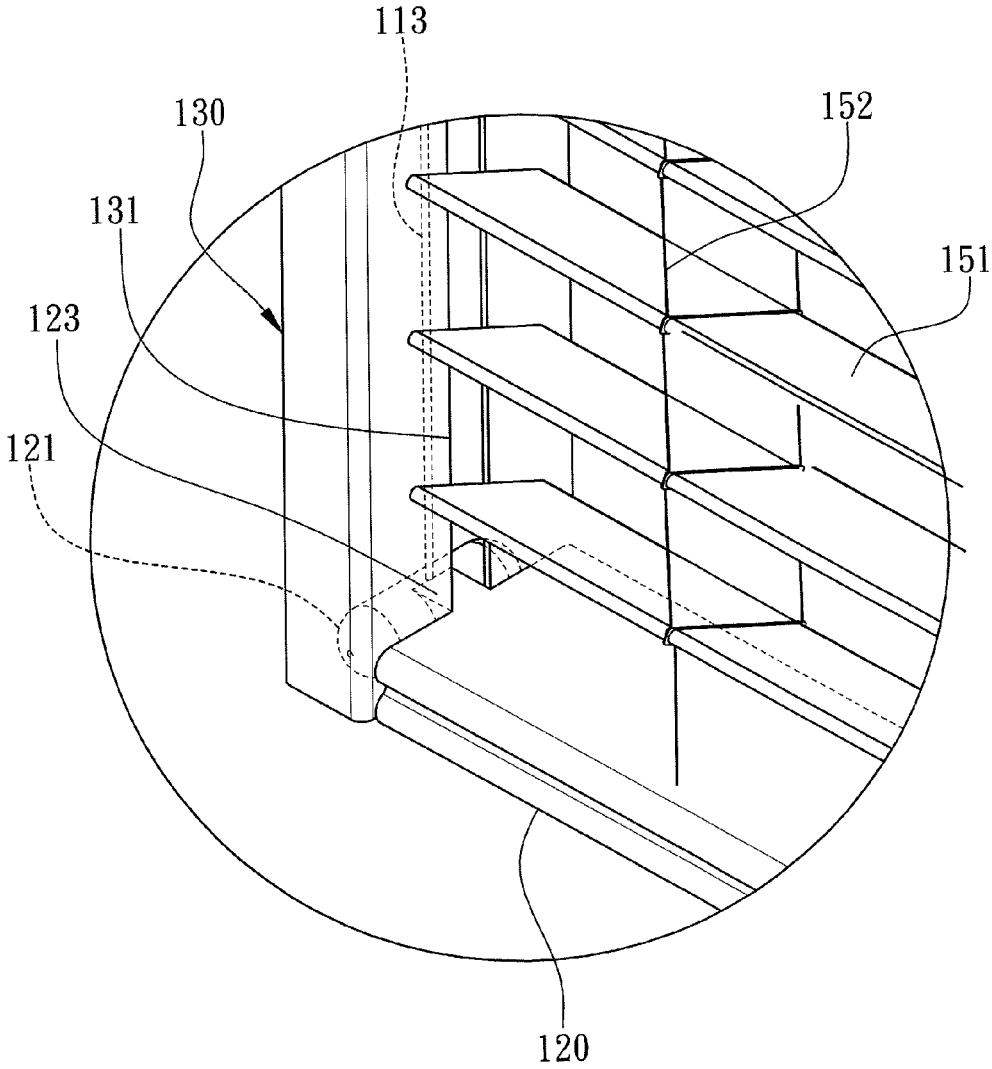
FIG. 3 is a partially three-dimensional view of the cordless blind assembly to illustrate the guiding component according to the first embodiment of the present invention.

According to the first embodiment of the present invention, a cordless blind assembly 100 is illustrated in FIG. 1 for a three-dimensional component exploded view, in FIG. 2 for a three-dimensional assembly view, and in FIG. 3 for a partially three-dimensional cross-sectional view. The cordless blind assembly 100 primarily comprises an upper frame rod 110, a retracting rod 120, a first side guiding rail 130, and a second side guiding rail 140.

A first cord winder 111 and a second cord winder 112 are installed at two opposing sides of the upper frame rod 110 to release and retract the first driving cord 113 and the second driving cord 114 respectively to further drive the retracting rod 120 up and down. In a preferred embodiment, the first cord winder 111 and the second cord winder 112 are connected to the same driving shaft 115 to synchronously release and retract the first retracing cord 113 and the second driving cord 114.

Figure 4:
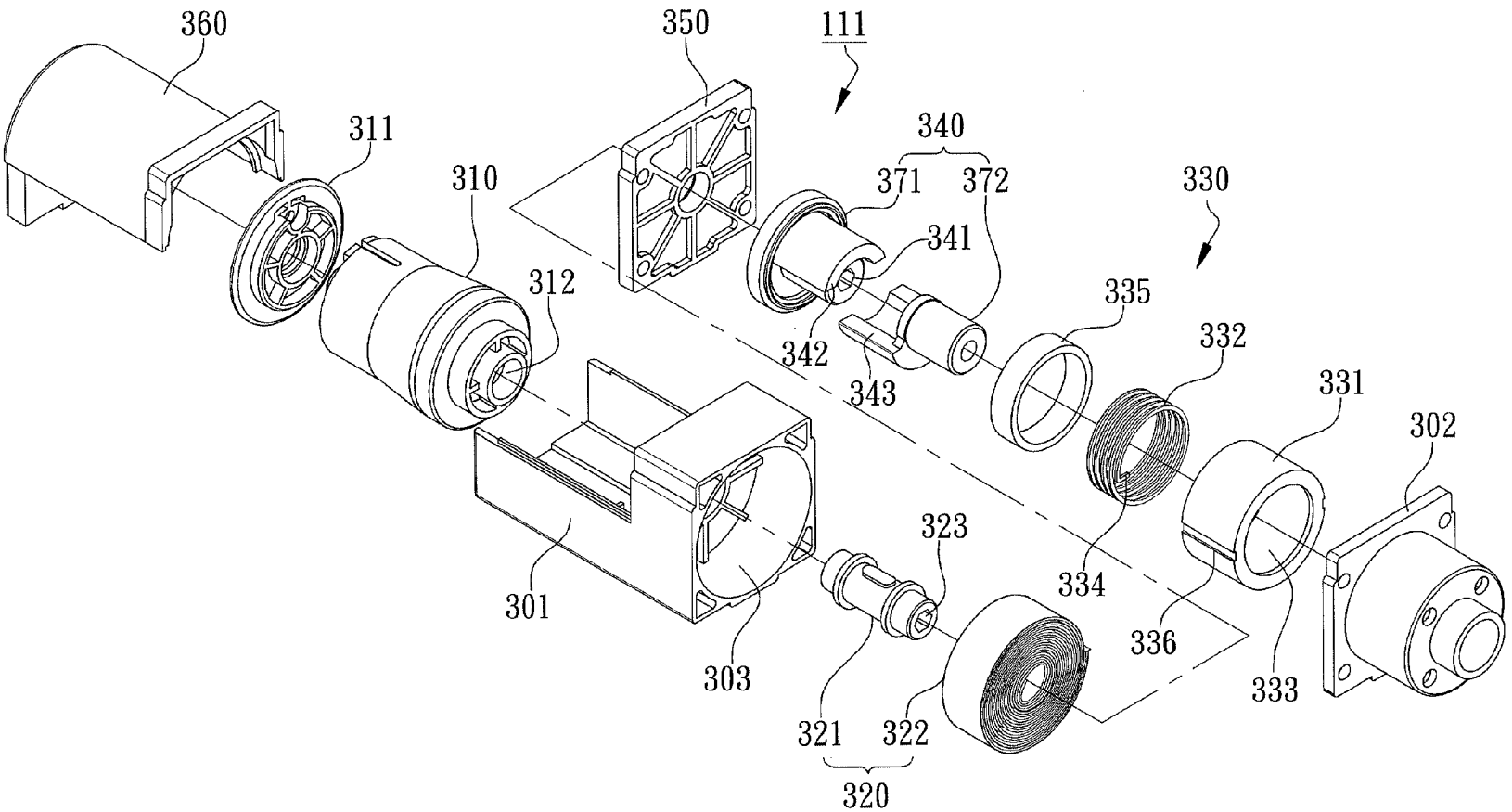
FIG. 4 is a three-dimensional component exploded view of a cord winder in the cordless blind assembly according to the first embodiment of the present invention.

Furthermore, the first cord winder 111 and the second cord winder 112 have the same structures. Preferable, each of the cord winders 111 and 112 has a stopping control mechanism where the first cord winder 111 is illustrated in FIG. 4 for a three-dimensional component exploded view.

The compartment of the first cord winder 111 has a first compartment 301 and a second compartment 302 jointed together. The stopping control mechanism of the first cord winder 111 primarily includes a spool 310, a force-return mechanism 320, and a braking cushion mechanism 330. The spool 310 is accommodated inside the first compartment 301 where one side of the first compartment 301 has a shaft cavity 303. The spool 310 will rotate as the driving shaft rotates to retract the first driving cord 113. For example, the spool 310 has a shaft jointing hole 312 located on the same axis for the driving shaft 115 to penetrate through and to rotate synchronously. A cover 360 is buckled to the other side of the first compartment 302 opposing to the shaft cavity 303 to confine the spool 310 inside the first compartment 301. Moreover, the spool 310 is jointed to a spool confining ring 311 located on the opposing side of the first driving cord 113 to prevent the first driving cord 313 from breaking away and to keep the spool 310 rotating axially. The force-return mechanism 320 is accommodated inside the shaft cavity 303 to provide elastic forces to retract the cordless blind assembly 100. The force-return mechanism 320 at least includes a shaft sleeve 321 and a volute spring 322. The shaft sleeve 321 has a shaft jointing hole 323 located on the same axis for the driving shaft 115 to penetrate through. One end of the volute spring 322 is connected to the shaft sleeve 321 and the other end of the volute spring 322 is connected to the shaft cavity 303 of the first compartment 301. For example, a buckling space is reserved on the side or at the corner of the shaft cavity 303 of the first compartment 301 where the corresponding end of the volute spring 322 is buckling to the buckling space. The retracting force of the volute spring 322 will provide the retracting force for the shaft sleeve 321 to rotate and retract. Preferably, a partition 350 is buckled at one side of the first compartment 301 located between the first compartment 301 and the second compartment 302 to confine the shaft sleeve 321 and the volute spring 322 inside the shaft cavity 303. The braking cushion mechanism 330 is accommodated inside the second compartment 302 and includes a friction ring 331, a friction spring 332, and a trigger sleeve 340. The trigger sleeve 340 has a shaft jointing hole 341 located on the same axis for the driving shaft 115 to penetrate through. The inwall of the friction ring 331 is a wear-proof annular inwall 333 where the external wall of the friction ring 331 has at least an alignment fillister 336. The second compartment 302 has a corresponding alignment buckle to firmly fix the friction ring 331 inside the second compartment 302 without any rotation. The friction spring 332 is tightly plugged inside the wear-proof annular inwall 333 with an extruded end 334 where variable friction forces in different rotation directions will be generated between the friction spring 332 and the friction ring 331 to prevent the trigger sleeve 340 from uni-directional rotation. The braking cushion mechanism 330 further includes a confining ring 335 which is plugged into the opening of the wear-proof annular inwall 333 to confine the friction spring 332 in the friction ring 331 from breaking away and to let one part of the trigger sleeve 340 to penetrate through. Preferably, the second compartment 302 is jointed to the partition 350 to confine the trigger sleeve 340 inside the second compartment 302 without affecting the assembly of the force-return mechanism 320. The afore described shaft jointing holes 312, 323, and 341 are not circular but can be triangular, tetragonal, hexagonal, non-circular trimmed annular holes or a jointing hole with a single or a plurality of axial confining bars so that it is not necessary to individually assemble and connect the spool 310, the shaft sleeve 321, and the trigger sleeve 340 together but can synchronously rotate. Therefore, the clockwise rotation of the driving shaft 115 will be able to synchronously release and retract the first driving cord 113 and the second driving cord 114 to further open/close the cordless blind assembly 100.

In the present embodiment, the trigger sleeve 340 is composed of the first separating component 371 and the second separating component 372 where the first separating component 371 has a trigger part 342 and the second separating component 372 has a stopping part 343. The shaft jointing hole 341 of the trigger sleeve 340 is disposed at the first separating component 271 or at the second separating component 272 which depends on the requirements. The extruded end 334 of the friction spring 332 is located at the gap between the trigger part 342 and the stopping part 343. To be more specific, the extruded end 334 of the friction spring 332 is extruded toward the axis of the friction spring 332 where the trigger part 342 and the stopping part 343 are plugged inside the friction spring 332. When the trigger part 342 touches the extruded end 334, the coil number of friction spring 332 will increase to relatively make the diameter of the friction spring 332 become smaller so that the friction between the friction spring 332 and the friction ring 331 will be decreased. When the stopping part 343 touches the extruded end 334, the diameter of the friction spring 332 will be increased, however, the friction ring 331 will confine the diameter increase of the friction spring 332 so that the friction between the friction spring 332 and the friction ring 331 will keep the same or slightly increase to keep the trigger sleeve 340 from rotation, i.e., the driving shaft 115 becomes effort-saving stopping mechanism with uni-directional rotation.

The retracting rod 120 is located beneath the upper frame rod 110 where a plurality of retractable blind shading parts 150 are disposed between the upper frame rod 110 and the retracting rod 120. In the present embodiment, the blind shading parts 150 can be one kind of window shades with a plurality of blind leaves 151 which are fixed by a plurality of tying strings 152 where the tying strings 152 are connected to the upper frame rod 110 and the retracting rod 120. Or, the blind shading parts 150 can be chosen from either Roman shade or Shutter curtain. The retracting rod 120 has a specific weight to achieve force balance during blind opening/closing which are made of wood, plastic, or plastic steel and can be hollow or solid.

Moreover, a first guiding component 121 is disposed on the first end of the retracting rod 120 and a second guiding component 122 is disposed on the second end of the retracting rod 120. In the present embodiment, the first guiding component 121 and the second guiding component 122 are integrally connected to the retracting rod 120. The first driving cord 131 goes around one side of the blind shading parts 150 to connect to the first guiding component 121 and the second driving cord 114 goes around the other side of the blind shading parts 150 to connect to the second guiding component 122. Therefore, the first driving cord 113 and the second driving cord 114 do not need to penetrate through the blind shading parts 150.

The top end of the first side guiding rail 130 is located at one side of the upper frame rod 110 to hide the first driving cord 113 where the first guiding component 121 can freely move inside the first side guiding rail 130. The top end of the second side guiding rail 140 is located at the other side of the upper frame rod 110 to hide the second driving cord 114 where the second guiding component 122 can freely move inside the second side guiding rail 140. Therefore, the first side guiding rail 130 and the second side guiding rail 140 are symmetrically disposed and are hanging down from the corresponding sides of the upper frame rod 110 to provide moving space of the first guiding component 121 and the second guiding component 122 and to hide the extended first driving cord 113 and the extended second driving cord 114 to keep the retracting rod 120 balance in horizontal direction during opening/closing the blind and to avoid unexpected winding of the first driving cord 113 and the second driving cord 114 and to prevent tilting or sticking of the retracting rod 120. Since the disposition of the first driving cord 113 and the second driving cord 114 do not need to penetrate through the blind shading parts 150 so that the structure of the blind shading parts 150 will not be damaged, moreover, it is easy to DIY a blind by users.

To be more specific, as shown in FIG. 1 and FIG. 4, the first guiding component 121 has a width-shrunk neck 123 and the second guiding component 122 has a width-shrunk neck 124 for individually connecting to the retracting rod 120. The first side guiding rail 130 has a slim slot 131 and the second guiding rail 140 also has a slim slot 141 1 where each of the slim slots 131, 141 has an opening width slightly larger than the width of the corresponding width-shrunk neck 123 and 124 so that the first and second guiding components 121 and 122 are limited inside the first and second side guiding rails 130 and 140 respectively. In a specific embodiment, the first guiding component 121 and the second guiding component 122 are perpendicular to the corresponding slim openings 131 and 141 and each guiding component has both ends with arc surfaces so that the first side guiding rail 130 and the second side guiding rail 140 can freely move. Preferably, the first driving cord 113 is connected to a central portion of the first guiding component 121 aligned with the corresponding neck 123 and the second driving cord 114 is also connected to a central portion of the second guiding component 122 aligned with the corresponding neck 124 to avoid shaking and winding of the retracting rod 120.

Therefore, the cordless blind assembly 100 of the present invention can prevent neck-strangling accidents with easy installation without breaking the function of the blind shading parts.

Figure 5:
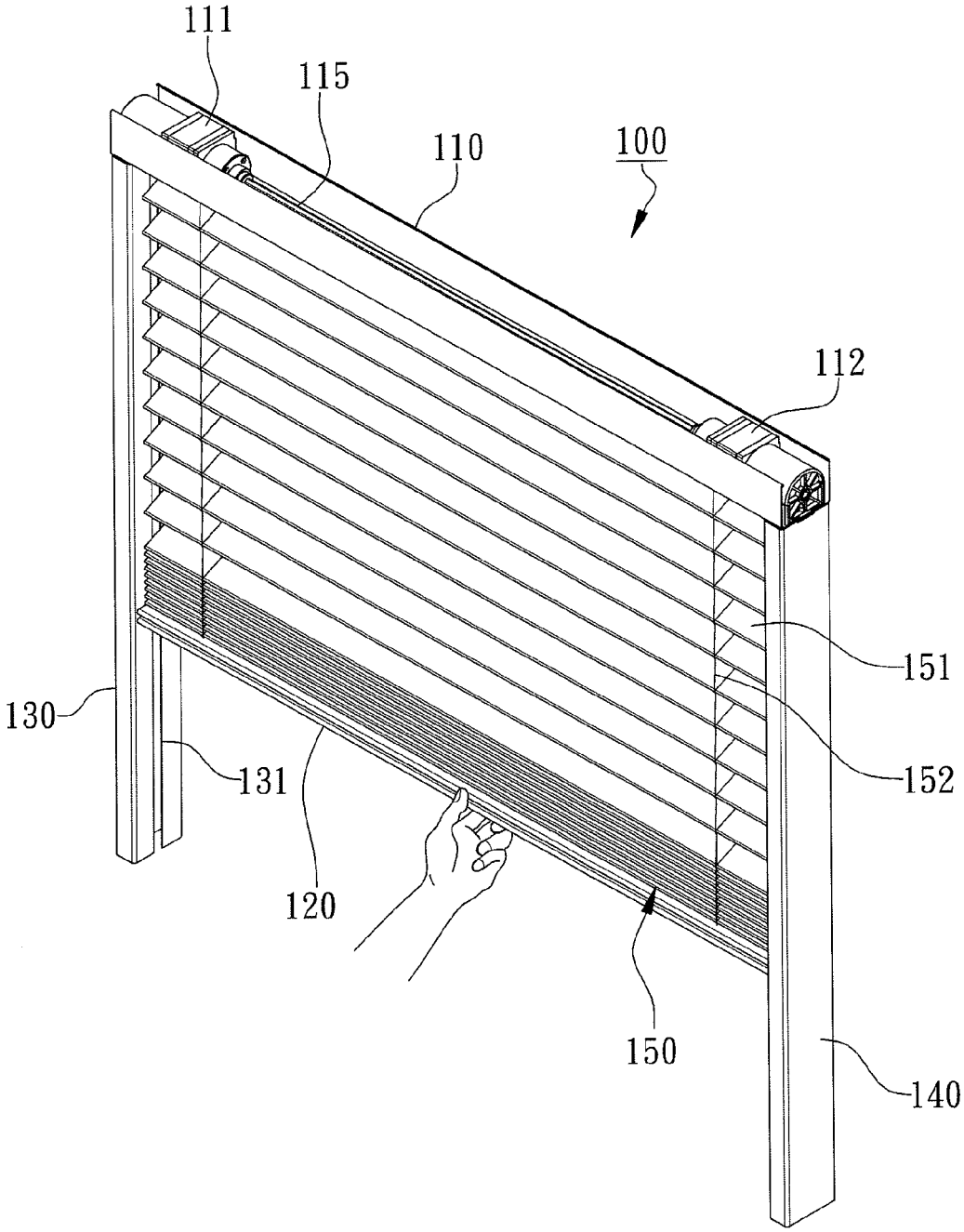
FIG. 5 is a three-dimensional view illustrating the operation of releasing and retracting the cordless blind assembly according to the first embodiment of the present invention.
Figure 6:
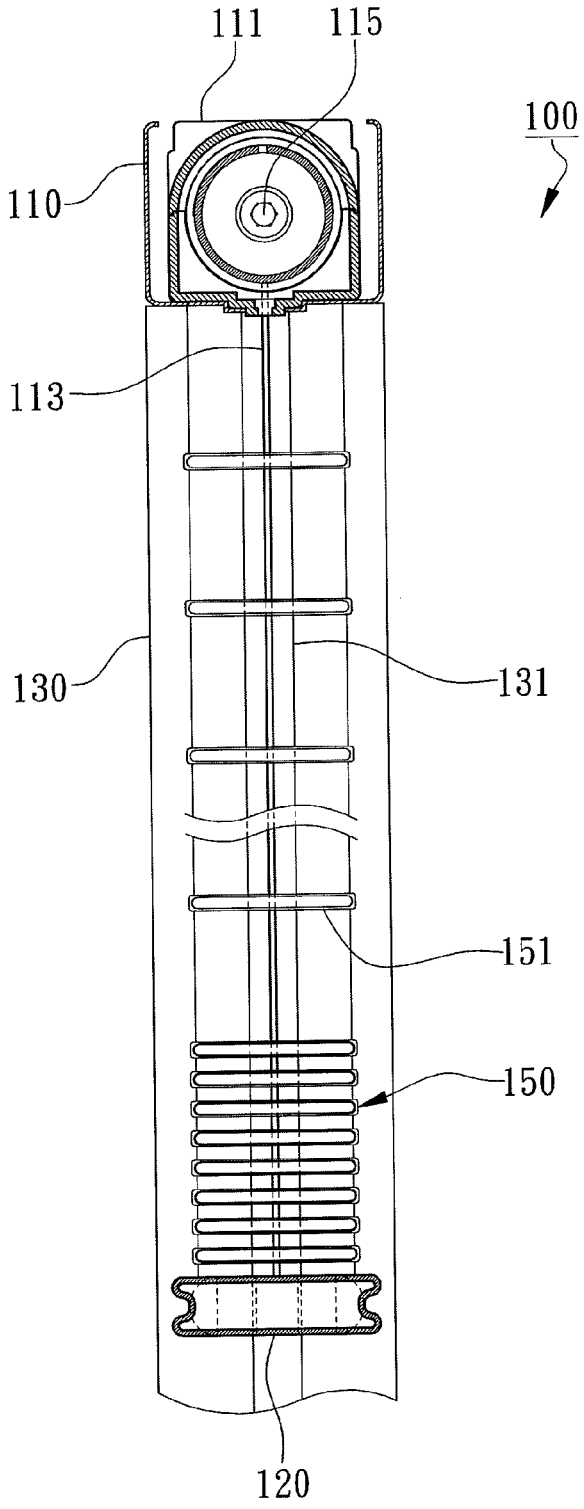
FIG. 6 is a side view illustrating the operation of releasing and retracting a cordless blind assembly according to the first embodiment of the present invention.

As shown in FIG. 5 and FIG. 6, when users exert an upward force on the retracting rod 120 of the cordless blind assembly 100, once the upward force and the retracting forces of the volute springs 322 is greater than the total gravity of the retracting rod 120 and the blind shading parts 150, then the trigger part 342 of the trigger sleeve 340 will touch the extruded end 334 of the friction spring 332 to slightly increase the coil number of the friction spring 332, i.e., to reduce the diameter of the friction spring 332, therefore, the friction between the friction spring 332 and the friction ring 331 will become smaller to drive and rotate the driving shaft 115 and the spool 310 to retract the first driving cord 113 and the second driving cord 114 so that the cordless blind assembly 100 can easily be lifted with a minimum force. Furthermore, when users exert a downward force to the retracting rod 120 to close the cordless blind assembly 100 which is in the same direction as the gravity of the cordless blind assembly 100, once the downward force and the gravity of the cordless blind assembly 100 is greater than the total force of the retracting force of the volute spring 322 and the maximum friction between the friction springs 332 and the friction rings 331, i.e., the stopping part 343 of the trigger sleeve 340 will touch the extruded end 334 of the friction spring 332, so that the retracting rod 120 can be lowered horizontally to achieve close the cordless blind assembly 100. When the downward force exerted by users becomes smaller, the retracting rod 120 can be stopped at any position.

Figure 7:
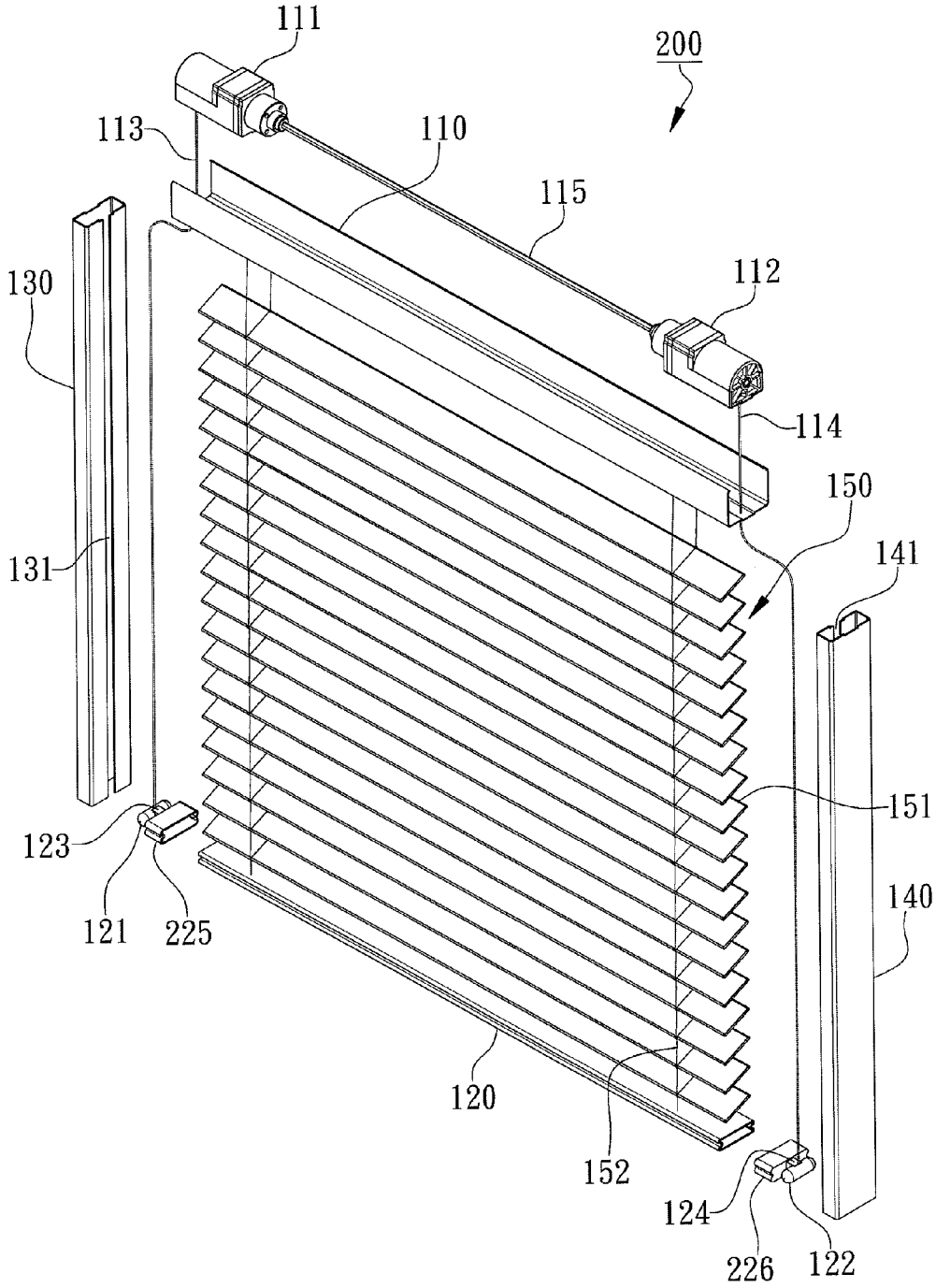
FIG. 7 is a three-dimensional component exploded view of another cordless blind assembly according to the second embodiment of the present invention.

According to the second embodiment of the present invention, another cordless blind assembly 200 is illustrated in FIG. 7 for a three-dimensional component exploded view. Since the major components and the assembly of both embodiments are quite similar, therefore, the component numbers used in the first embodiment will be adapted in the second embodiment. The cordless blind assembly 200 primarily comprises an upper frame rod 110 with cord winders 111 and 112 disposed on both ends, a retracting rod 120 disposed beneath the upper retracting rod 120, a first side guiding rail 130, and a second side guiding rail 140. A first guiding component 121 is disposed on one end of the retracting rod 120 and a second guiding component 122 is disposed on the other end of the retracting rod 120. The first driving cord 113 of the first cord winder 111 goes around one side of the blind shading parts 150 to connect to the first guiding component 121 and the second driving cord 114 of the second cord winder 112 goes around the other end of the blind shading parts 150 to connect to the second guiding component 122. The first side guiding rail 130 will hide the extended first driving cord 113 where the first guiding component 121 can freely move inside the first side guiding rail 130. The second side guiding rail 140 will hide the extended second driving cord 114 where the second guiding component 122 can freely move inside the second side guiding rail 140. In the present embodiment, the first guiding component 121 and the second guiding component 122 can be detachable components where each of the first guiding component 121 and the second guiding component 122 has a jointing part 225 and 226 respectively to connect to the retracting rod 120. Comparing to the unibody type guiding components, the cordless blind assembly 200 with guiding components having jointing parts can be easily DIY and the retracting rod 120 can easily be manufactured. Therefore, the cordless blind assembly 200 can also prevent neck-strangling accidents with easy installation without breaking the function of the blind shading parts.

The above description of embodiments of this invention is intended to be illustrative but not limited. Other embodiments of this invention will be obvious to those skilled in the art in view of the above disclosure which still will be covered by and within the scope of the present invention even with any modifications, equivalent variations, and adaptations.

What is claimed is:

1. A cordless blind assembly, comprising:

an upper frame rod including a first cord winder and a second cord winder disposed at two opposing ends to release and retract a first driving cord and a second driving cord;

a retracting rod located beneath the upper frame rod, wherein a plurality of retractable blind shading parts are disposed between the upper frame rod and the retracting rod, wherein a first guiding component is disposed on a first end of the retracting rod and a second guiding component is disposed on a second end of the retracting rod; wherein the first driving cord goes around one side of the blind shading parts to connect to the first guiding component and the second driving cord goes around the other side of the blind shading parts to connect to the second guiding component;

a first side guiding rail having a first top end located at one side of the upper frame rod to hide the extended first driving cord with the first guiding component freely moving inside the first side guiding rail; and a second side guiding rail having a second top end located at the other side of the upper frame rod to hide the extended second driving cord with the second guiding component freely moving inside the second side guiding rail;

wherein each of the first cord winder and the second cord winder has a stopping control mechanism, wherein the stopping control mechanism includes a spool, a force-return mechanism, and a braking cushion mechanism, wherein the spool is accommodated inside a first compartment for retracting the corresponding driving cord, wherein one side of the first compartment has a shaft cavity, wherein the force-return mechanism is accommodated inside the shaft cavity, wherein the braking cushion mechanism is accommodated inside a second compartment and includes a friction ring, a friction spring, and a trigger sleeve, wherein the friction ring is immovably fixed inside the housing with a wear-proof annular inwall, wherein the friction spring is tightly plugged inside the wear-proof annular inwall of the friction spring and has an extruded end, wherein the friction between the friction spring and the friction ring is reduced when a trigger part of the trigger sleeve is in contact with the extruded end.

2. The cordless blind assembly as claimed in claim 1, wherein each of the first guiding component and the second guiding component has a width-shrunk neck for individually connecting to the retracting rod, wherein each of the first side guiding rail and the second guiding rail has a slim slot with an opening width slightly greater than the width of the corresponding width-shrunk neck so that the first and second guiding components are limited inside the first and second side guiding rails respectively.

3. The cordless blind assembly as claimed in claim 2, wherein the first driving cord is connected to a central portion of the first guiding component aligned with the corresponding width-shrunk neck and the second driving cord is also connected to a central portion of the second guiding component aligned with the corresponding width-shrunk neck.

4. The cordless blind assembly as claimed in claim 2, wherein the first guiding component and the second guiding component are perpendicular to the corresponding slim slots and have both ends with arc surfaces.

5. The cordless blind assembly as claimed in claim 1, wherein the first guiding component and the second guiding component are detachable components wherein each of the first guiding component and the second guiding component has a jointing part to connect to the retracting rod.

6. The cordless blind assembly as claimed in claim 1, wherein the first guiding component and the second guiding component are integrally unibodies connected to the retracting rod.

7. The cordless blind assembly as claimed in claim 1, wherein the blind shading parts are one kind of window shades with a plurality of blind leaves which are fixed by a plurality of tying strings where tying strings are connected to the upper frame rod and the retracting rod.

8. The cordless blind assembly as claimed in claim 1, wherein the blind shading parts are chosen from either Roman shade or Shutter curtain.

9. The cordless blind assembly as claimed in claim 1, wherein the first cord winder and the second cord winder are connected with the same axis to synchronously release and retract the first driving cord and the second driving cord.

10. The cordless blind assembly as claimed in claim 1, wherein the force-return mechanism includes a shaft sleeve and a volute spring.

11. The cordless blind assembly as claimed in claim 1, wherein the braking cushion mechanism further includes a confining ring plugged into the opening of the wear-proof annular inwall to confine the friction spring in the friction ring.

* * * * *